US012522467B2

(12) United States Patent
Schlegel et al.

(10) Patent No.: US 12,522,467 B2
(45) Date of Patent: Jan. 13, 2026

(54) HOSE REEL ASSEMBLY

(71) Applicant: HUSQVARNA AB, Huskvarna (SE)

(72) Inventors: Tobias Schlegel, Illerkirchberg (DE); Rainer Kaupp, Blaubeuren (DE)

(73) Assignee: HUSQVARNA AB, Huskvarna (SE)

( * ) Notice: Subject to any disclaimer, the term of this patent is extended or adjusted under 35 U.S.C. 154(b) by 227 days.

(21) Appl. No.: 18/080,826

(22) Filed: Dec. 14, 2022

(65) Prior Publication Data

US 2023/0382680 A1 Nov. 30, 2023

(30) Foreign Application Priority Data

May 31, 2022 (EP) ..... 22176338

(51) Int. Cl.
*B65H 75/40* (2006.01)
*B65H 75/44* (2006.01)

(52) U.S. Cl.
CPC ..... *B65H 75/406* (2013.01); *B65H 75/4402* (2013.01); *B65H 75/4486* (2013.01);
(Continued)

(58) Field of Classification Search
CPC ..... B65H 75/34; B65H 75/38; B65H 75/406; B65H 75/4402; B65H 75/4442;
(Continued)

(56) References Cited

U.S. PATENT DOCUMENTS 1,675,140 A * 6/1928 Schenderlein ..... B65H 75/4471
242/379.2
6,149,096 A * 11/2000 Hartley ..... B65H 75/40
191/12.2 A (Continued)

FOREIGN PATENT DOCUMENTS

CN 103828162 A 5/2014
CN 104395214 A 3/2015

(Continued)

OTHER PUBLICATIONS

First Notice of Examination Opinions from corresponding Chinese Application No. 202211673897, mailed Aug. 31, 2025, all pages cited in its entirety.

*Primary Examiner* — Anna M Momper
*Assistant Examiner* — Ermia E. Melika
(74) *Attorney, Agent, or Firm* — Burr & Forman

(57) ABSTRACT

A mobile hose reel assembly (100) includes a housing (110). The housing (110) includes a first wall (112), a second wall (114) coupled with and disposed opposite to the first wall (112) and a handle portion (116) coupled with the first wall (112) and the second wall (114). The housing (110) further includes a hose reel module (120) housed within the housing (110). The hose reel module (120) includes a hose reel (122), a drive motor (124) operatively coupled to the hose reel (122) and a transmission mechanism (126) adapted to transmit the motion of the drive motor (124) to the hose reel (122). The mobile hose reel assembly (100) is characterized in that the hose reel module (120) is adapted to exhibit a rocking motion relative to the housing (110). Further, the drive motor (124) is selectively activated and deactivated based on the rocking motion of the hose reel module (120) relative to the housing (110).

19 Claims, 5 Drawing Sheets

(52) U.S. Cl.
CPC ..... *B65H 2403/20* (2013.01); *B65H 2403/40* (2013.01); *B65H 2403/82* (2013.01); *B65H 2701/33* (2013.01)

(58) Field of Classification Search
CPC ..... B65H 75/4457; B65H 75/4471; B65H 75/4486; B65H 79/00; B65H 59/382; B65H 59/387; B65H 2403/20; B65H 2403/40; B65H 2403/82; B65H 2701/33; B65H 75/4484
USPC ..... 242/388.9, 390, 391.2, 391.3, 405.3
See application file for complete search history.

(56) References Cited

U.S. PATENT DOCUMENTS

| | | | | |
|---|---|---|---|---|
| 2005/0017117 | A1 | 1/2005 | Moon et al. | |
| 2005/0087644 | A1 | 4/2005 | Kim | |
| 2016/0145071 | A1* | 5/2016 | Jawidzik | B65H 75/4434 242/388.9 |
| 2016/0311643 | A1* | 10/2016 | Tracey | B65H 75/4471 |
| 2019/0109449 | A1* | 4/2019 | Van der Paal | H02G 11/02 |
| 2019/0248621 | A1* | 8/2019 | Tracey | B65H 75/4478 |
| 2020/0095088 | A1* | 3/2020 | Kierath | B65H 75/4486 |

FOREIGN PATENT DOCUMENTS

| | | | | |
|---|---|---|---|---|
| CN | 210682603 | U | 6/2020 | |
| CN | 113682902 | A * | 11/2021 | B65H 75/4486 |
| CN | 219429405 | U | 7/2023 | |
| DE | 202009016259 | U1 | 3/2010 | |
| DE | 202022101881 | U1 | 4/2022 | |
| EP | 1411016 | A2 | 4/2004 | |
| EP | 1601245 | B1 | 2/2011 | |
| EP | 2624966 | B1 | 5/2016 | |
| KR | 200339595 | Y1 | 1/2004 | |
| KR | 200339596 | Y1 | 1/2004 | |
| KR | 200346451 | Y1 | 3/2004 | |
| KR | 20090002911 | A | 1/2009 | |
| KR | 1020190106898 | A | 9/2019 | |
| KR | 102031442 | B1 | 10/2019 | |
| KR | 102127318 | B1 | 6/2020 | |
| KR | 102178927 | B1 | 11/2020 | |
| WO | WO-2006075137 | A2 * | 7/2006 | B65H 75/4465 |

* cited by examiner

HOSE REEL ASSEMBLY

TECHNICAL FIELD

The present disclosure relates to a hose reel assembly. More specifically, the present disclosure relates to a mobile hose reel assembly, which allows efficient and user-friendly operation.

BACKGROUND

A hose reel assembly is used to provide a flow of fluid, such as water, in spaces, such as lawns, parks, and the like. Generally, the hose reel assembly is fixedly mounted on a wall, or a ground. However, such hose reel assemblies are non-ergonomic and have limited reach due to a stationary set-up.

An improvement to the historically (or conventionally) used hose reel assemblies is a mobile hose reel assembly. The mobile hose reel assembly is portable and may be carried from one location to another for various domestic as well as industrial applications.

The mobile hose reel assembly may be fluidly coupled with a fluid source (say a water tap) and may further be taken to a garden, or the like for supplying fluid received from the fluid source. While moving away from the fluid source, a hose of the mobile hose reel assembly fluidly coupled with the fluid source may unwind from a corresponding (or associated) hose reel due to hose tension. The hose tension may be generated due to fluid coupling between the fluid source and the hose.

Further, while moving away from the fluid source, the unwinded hose touches every obstacle in the way, especially, in balconies, terraces, small gardens or the like and may even get stuck with the obstacles due to the tension in the hose. This may lead to a cumbersome experience for an operator of the hose reel assembly. Hence, an improved mobile hose reel assembly is required that may be capable of releasing the hose tension during the unwinding operation of the hose reel and may be easily maneuvered around obstacles.

An example of a hose reel assembly is provided in Korean patent KR 10 2127 318 (hereinafter referred to as '318 reference). The '318 reference provides an automatic hose reel device for agriculture. The automatic hose reel device includes a pair of guide rollers which guide a hose when the hose is released; a sensor unit attached to the pair of guide rollers to measure the tension of the hose released from a hose reel; a motor which rotates a central axis of the hose reel by a belt; a control unit receiving the measured tension value of the hose from the sensor unit and controlling the rotation speed of the motor according to the measured tension value; and a wireless remote control for winding the hose or stopping the rotation of the motor. The unwinding and winding speed of the hose reel are variably controlled by the control unit according to the tension value applied to the hose, so that an operator does not need to operate a switch of the automatic hose reel device every time, thereby increasing the efficiency of work. However, the '318 reference seems short of disclosing the hose reel assembly, which may be user-friendly, portable, and movable to different locations for watering, storage, or any other application. Further, the tension of the hose is understood by employing the sensor unit, which measures the tension value and communicates the same with the control unit. The motor is then driven based on complex algorithms stored in the control unit, which adds to the complexity of the hose reel assembly and further adds maintenance and operational costs for the operator of the hose reel assembly.

Thus, there is a need of an improved hose reel assembly which has a simple operational design architecture and allows easy, portable, and ergonomic operation.

SUMMARY

In view of the above, it is an objective of the present invention to solve or at least reduce the drawbacks discussed above. The objective is at least partially achieved by a mobile hose reel assembly. The mobile hose reel assembly includes a housing. The housing includes a first wall, a second wall coupled with and disposed opposite to the first wall and a handle portion coupled with the first wall and the second wall. The housing further includes a hose reel module housed within the housing. The hose reel module includes a hose reel, a drive motor operatively coupled to the hose reel and a transmission mechanism adapted to transmit the motion of the drive motor to the hose reel. The mobile hose reel assembly is characterized in that the hose reel module is adapted to exhibit a rocking motion relative to the housing. Further, the drive motor is selectively activated and deactivated based on the rocking motion of the hose reel module relative to the housing.

Thus, the present disclosure provides the mobile hose reel assembly that is moved or carried to different locations for fluid distribution intended for various industrial and domestic applications. The mobile hose reel assembly is simple and ergonomic for usage by an operator. The mobile hose reel assembly is compact and includes the hose reel module that advantageously exhibits the rocking motion within the housing of the mobile hose reel assembly. The hose reel module includes the hose reel and the drive motor (say an electric motor) mechanically coupled with the hose reel. The drive motor facilitates automatic unwinding of a hose of the hose reel assembly. The drive motor is selectively activated and deactivated based on the rocking motion of the hose reel module relative to the housing. The hose reel module tends to swivel towards a hose outlet of the mobile hose reel assembly when a tensile force acts on the hose reel or the hose reel module (possibly due to the fluid connection of the hose with a fluid source). This is detected by control electronics provided with the mobile hose reel assembly and the drive motor is automatically activated for unwinding of the hose. The drive motor further relieves the tension in the hose such that the operator easily maneuvers around one or more obstacles in a fluid distribution area without the hose getting caught or stuck with the one or more obstacles such as, but not limited to, trees, planting pots, and the like, thereby improving the overall efficiency of the mobile hose reel assembly.

According to an embodiment of the present disclosure, the drive motor is selectively activated and deactivated by a switch. The drive motor may be manually activated or deactivated by the switch as per the application requirement. The drive motor may be activated or deactivated in case of failure of electronics associated with detecting the rocking movement of the hose reel module. Further, the switches are inexpensive, compact, and easily available for use with various applications.

According to an embodiment of the present disclosure, the drive motor is selectively activated and deactivated by detecting an angle of a hose winded on the hose reel. The hose may undergo change in angle (or orientation) relative to the hose reel module upon exposure to tensile force experienced for example, when the hose is coupled to the fluid source. The change in angle may be detected or measured by any means known in the art and may be used to selectively activate and deactivate the drive motor for smooth functioning of the mobile hose reel assembly.

According to an embodiment of the present disclosure, the transmission mechanism adapted to transmit the motion of the drive motor to the hose reel is a gear mechanism. However, in some embodiments, the transmission mechanism adapted to transmit the motion of the drive motor to the hose reel is a belt-drive mechanism. Either of the gear mechanism or the belt-drive mechanism may be used as per the application requirements, space constraint, maintenance, life-expectancy, among other factors.

According to an embodiment of the present disclosure, a speed of the hose reel is adapted to be equivalent to walking speed of an operator when the amount of hose on the hose reel is changing during unwinding. The operator may fluidly couple the hose with the fluid source and walk away from the fluid source for unwinding of the hose. The speed of rotation of the hose reel may change with the changing radius of the hose winded on the hose reel and may differ from the constant speed of the hose or walking speed of the operator. This may lead to cumbersome unwinding of the hose. The speed of rotation of the hose reel may thus be controlled using a set of equalizing or differential gear set.

According to an embodiment of the present disclosure, the mobile hose reel assembly includes a pair of guide rolls for guiding the hose during the winding and unwinding operation of the hose. The pair of guide rolls allows efficient winding and unwinding of the hose. The pair of guide rolls prevent chaotic hose winding or hose entanglement inside the hose reel.

According to an embodiment of the present disclosure, the mobile hose reel assembly includes a slider adapted to regulate the speed of the hose reel. The slider may be used to regulate the speed of the hose reel such that the tension in the hose is always relieved during the unwinding operation. In some embodiments of the present disclosure, the slider disengages the transmission of power between the drive motor and the hose reel.

According to an embodiment of the present disclosure, the at least one of the guide rolls from the pair of guide rolls is driven by the drive motor. This improves the unwinding of the hose from the hose reel. It is obvious that the hose reel and at least one of the guide rolls can be coupled and thus driven together but it has not to be the case. In one embodiment it is also possible to only drivingly couple hose reel and at least one of the guide rolls only when winding or when unwinding the hose. In the situation where there is no drivingly coupling necessary it is possible to employ a free wheel clutch or the like.

According to an embodiment of the present disclosure, the pair of guide rolls and the hose reel are simultaneously driven during winding and unwinding by installing an equalizing or differential gear set between the pair of guide rolls and the hose reel. It is obvious that alternatively or in addition to this gear set the simultaneous drive can also be achieved by sensing the hose speed and controlling the speed or speeds of revolution accordingly. With the help of this an entanglement of the hose during usage of the tool can widely be avoided.

Other features and aspects of this invention will be apparent from the following description and the accompanying drawings.

BRIEF DESCRIPTION OF THE DRAWINGS

The invention will be described in more detail with reference to the enclosed drawings, wherein.

DESCRIPTION OF EMBODIMENTS

Figure 1:
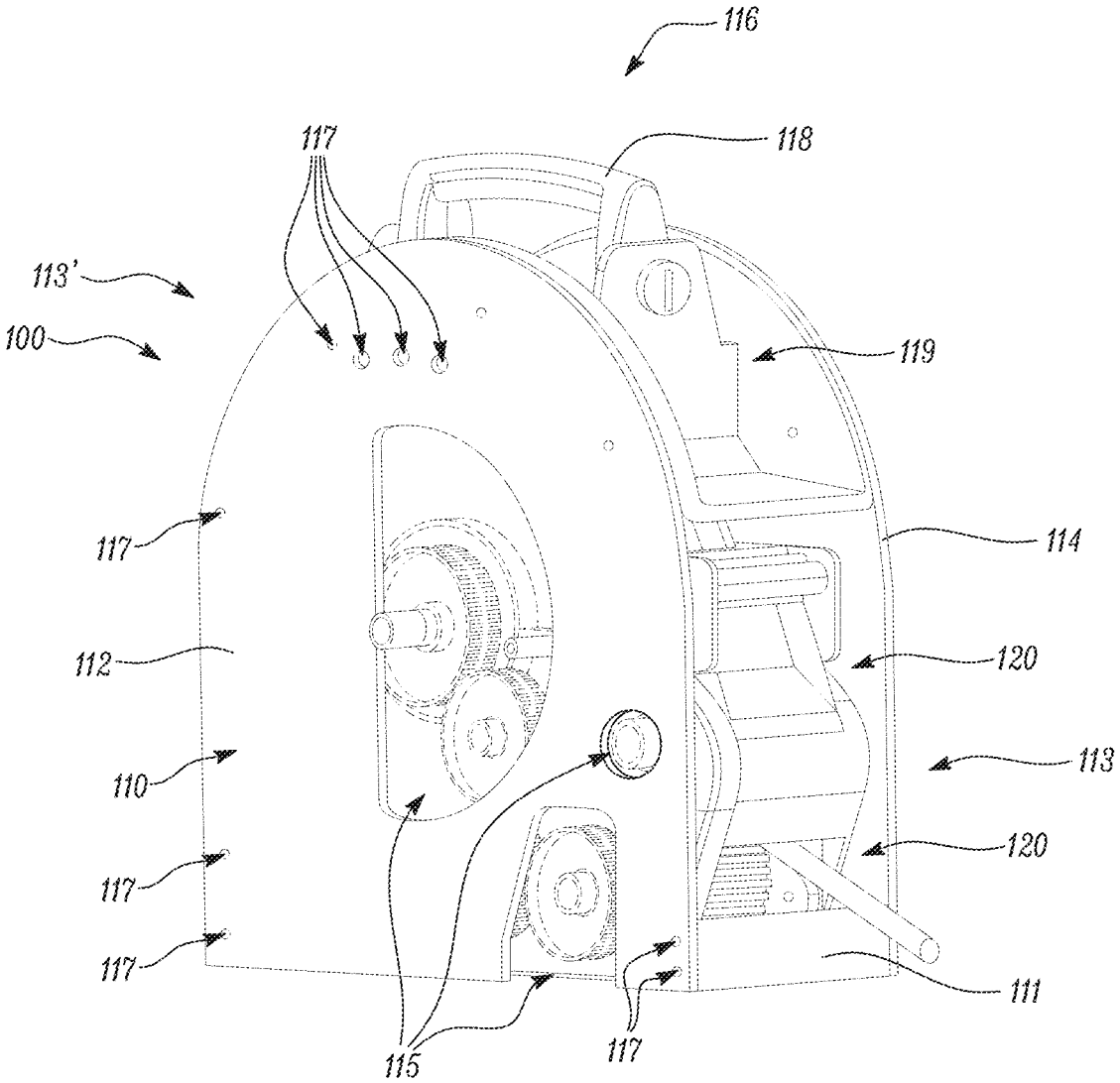
FIG. 1 shows a perspective view of a mobile hose reel assembly, in accordance with an aspect of the present disclosure.

The present invention will be described more fully hereinafter with reference to the accompanying drawings, in which example embodiments of the invention incorporating one or more aspects of the present invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention may be utilized in other embodiments and even other types of structures and/or methods. In the drawings, like numbers refer to like elements.

Certain terminology is used herein for convenience only and is not to be taken as a limitation on the invention. For example, "upper", "lower", "front", "rear", "side", "longitudinal", "lateral", "transverse", "upwards", "downwards", "forward", "backward", "sideward", "left," "right," "horizontal," "vertical," "upward", "inner", "outer", "inward", "outward", "top", "bottom", "higher", "above", "below", "central", "middle", "intermediate", "between", "end", "adjacent", "proximate", "near", "distal", "remote", "radial", "circumferential", or the like, merely describe the configuration shown in the Figures. Indeed, the components may be oriented in any direction and the terminology, therefore, should be understood as encompassing such variations unless specified otherwise.

FIG. 1 illustrates a mobile hose reel assembly 100. The mobile hose reel assembly 100 of the present disclosure may find application in various technical fields such as those belonging to firefighting, gardening, surface cleaning and the like. The mobile hose reel assembly 100 is easily and ergonomically moved or carried to different locations for fluid distribution intended for various applications.

The mobile hose reel assembly 100 includes a housing 110. The housing 110 includes a first wall 112 and a second wall 114 coupled with and disposed opposite to the first wall 112. The first wall 112 and the second wall 114 may be temporarily or permanently attached to each other, such as by fasteners, screws, any suitable means as used or known in the art. However, for the purpose of present disclosure, the first wall 112 and the second wall 114 are coupled to each other using a pair of brackets 111 such that one of the pair of brackets 111 couples the first wall 112 and the second wall 114 in a front portion 113 of the housing 110 of the mobile hose reel assembly 100 and the other bracket couples the first wall 112 and the second wall 114 in a back portion 113' of the housing 110 of the mobile hose reel assembly 100.

The first wall 112 and the second wall 114 may have a circular, a rectangular or any other shape without limiting the scope of the disclosure. In a preferred embodiment of the present disclosure, the first wall 112 and the second wall 114 may have same shape and size. However, in some embodiments, the first wall 112 and the second wall 114 may have different shape and size as per the application requirement of the present disclosure.

In some embodiments, either the first wall 112 or the second wall 114 includes a plurality of windows 115 (or cut-outs) to view or access the inside of the housing 110 for maintenance purpose or the like. In some embodiments, both the first wall 112 and the second wall 114 includes the plurality of windows 115. The plurality of windows 115 may have any number, shape, or size according to the functional requirements of the present disclosure. In some embodiments, the plurality of windows 115 may be covered by a transparent door (not shown) such that the transparent door may be hingedly engaged with the first wall 112 and the second wall 114 and may be opened only when required. The transparent door may prevent unwanted entry of foreign elements to the inside of the housing 110.

Further, in some embodiments of the present disclosure, either the first wall 112 or the second wall 114 or both the first wall 112 and the second wall 114 includes a plurality of pre-drilled holes 117. The plurality of pre-drilled holes 117 may advantageously be used for fastening various accessories inside or outside of the housing 110 as per the application requirements. For example, the pre-drilled holes 117 may be used to fasten an angle adjustable holder. The angle adjustable holder may allow ease of storing of different accessories such as nozzles, which may be removably attached to a hose 121 of the mobile hose reel assembly 100.

The plurality of pre-drilled holes 117 prevent efforts by an operator to drill the holes 117 and further prevent unwanted or unintentional tampering of the first wall 112 and the second wall 114 of the housing 110. The number, shape, size, and positioning of the plurality of pre-drilled holes 117 may be pre-determined in the manufacturing facility based on possible application requirements, among other factors. In some embodiments, the plurality of pre-drilled holes 117 may be provided with removable plugs such that the plugs may be removed from the selected holes 117 as and when required for further usage of the holes 117.

In some embodiments, the first wall 112 and the second wall 114 of the housing 110 may be made from metal, fiberglass, or plastic. However, any other material may be used without limiting the scope of the present disclosure in any manner. Further, the first wall 112 and the second wall 114 may be manufactured from any known manufacturing means commonly utilized in the related art.

With continued reference to FIG. 1, the housing 110 further includes a handle portion 116 coupled with the first wall 112 and the second wall 114. The handle portion 116 includes a handle 118 and a connecting portion 119. The handle 118 may be connected to the connecting portion 119 by any means known in the art. However, for the purpose of present disclosure, the handle 118 includes a protrusion on each side of the handle such that each of the protrusion is inserted in a corresponding slot provided on each side of the connection portion 119. The protrusion and slot provide secure attachment between the handle 118 and the connecting portion 119 of the handle portion 116. Further, the handle portion 116 may be coupled with the first wall 112 and the second wall 114 by any means known and understood in the related art without posing any limitation to the scope of the present disclosure. Thus, the first wall 112, second wall 144 and the handle portion 116 when coupled together form the housing 110 of the mobile hose reel assembly 100.

The operator may simply carry the mobile hose reel assembly 100 from one location to the other by grasping the handle 118 of the housing 110. In some embodiments, the handle 118 may be defined as an inverted U-shaped portion. However, the handle 118 may have any other shape as well without limiting the scope of the present disclosure.

In some embodiments, the handle 118 may be pivotally secured to the connecting portion 119 of the handle portion 116. The pivotable handle 118 may make it easier, safer to put down and pick up the mobile hose reel assembly 100, such as from the ground surface (not shown). The pivotable handle 118 may be turned up while the mobile hose reel assembly 100 is in a grounded position leading to a convenient access for different individuals. The pivotable handle 118 may also make the mobile hose reel assembly 100 more compact for packaging, storage, and travel. In some embodiments, the handle 118 may include a locking mechanism to lock the handle 118 in the pivotable position. The locking mechanism may provide a safe and trouble-free operation by disallowing any accidental movement of the pivotable handle 118.

In some embodiments, the handle 118 may be telescopic handle to allow a change in length thereof, and to further improve the ergonomics while picking up the mobile hose reel assembly 100. In some embodiments, the handle 118 may include a grip portion such that the grasping of the grip portion of the handle 118 may provide better hold and safe working, movability of the mobile hose reel assembly 100 between locations. The material used for the grip portion may preferably be, but need not necessarily, PVC or nitrile rubber, or any other plastic or polymer to suit application needs.

In some embodiments, the housing 110 may include one or more wheels not shown. The one or more may preferably be provided proximate to the bottom portion of the housing 110 by any means known in the related art. The one or more wheels may ease support and movement of the mobile hose reel assembly 100 on the ground surface or improve portability between different locations/installations. In some embodiments, the one or more wheels may be of any size, shape, type to facilitate easy and convenient movement of the mobile hose reel assembly 100 on the ground surface or for any other application requirements.

In some embodiments, the one or more wheels may be caster wheels. The caster wheels may help to easily manipulate the mobile hose reel assembly 100 on the ground surface. In some embodiments, the one or more wheels may be powered by an electric motor (not shown), or any other powering means. In some embodiments, the one or more wheels may be removably coupled with the housing 110. The one or more wheels may be removable to allow easy servicing, or even replacement, of the one or more wheels. Further, the removable feature of the one or more wheels may make the mobile hose reel assembly 100 more compact for packaging.

The housing 110 as illustrated in FIG. 1 further includes a hose reel module 120 housed within the housing 110. The hose reel module 120 of the present disclosure is illustrated in detail in FIGS. 2 and 3. The hose reel module 120 includes a pair of side walls 123 coupled with and disposed opposite to each other. The pair of side walls 123 may be temporarily or permanently attached to each other, such as by fasteners, screws, any suitable means as used or known in the art. However, for the purpose of present disclosure, the pair of side walls 123 are coupled to each other using a pair of brackets 125 such that one of the pair of brackets 125 couples the pair of side walls 123 in a front portion 127 of the hose reel module 120 of the mobile hose reel assembly 100 and the other bracket couples the pair of side walls 123 in a back portion 127' of the hose reel module 120 of the mobile hose reel assembly 100. The pair of side walls 123 are additionally coupled by a bracket 125' to impart more strength to the coupling between the pair of side walls 123.

Figure 2:
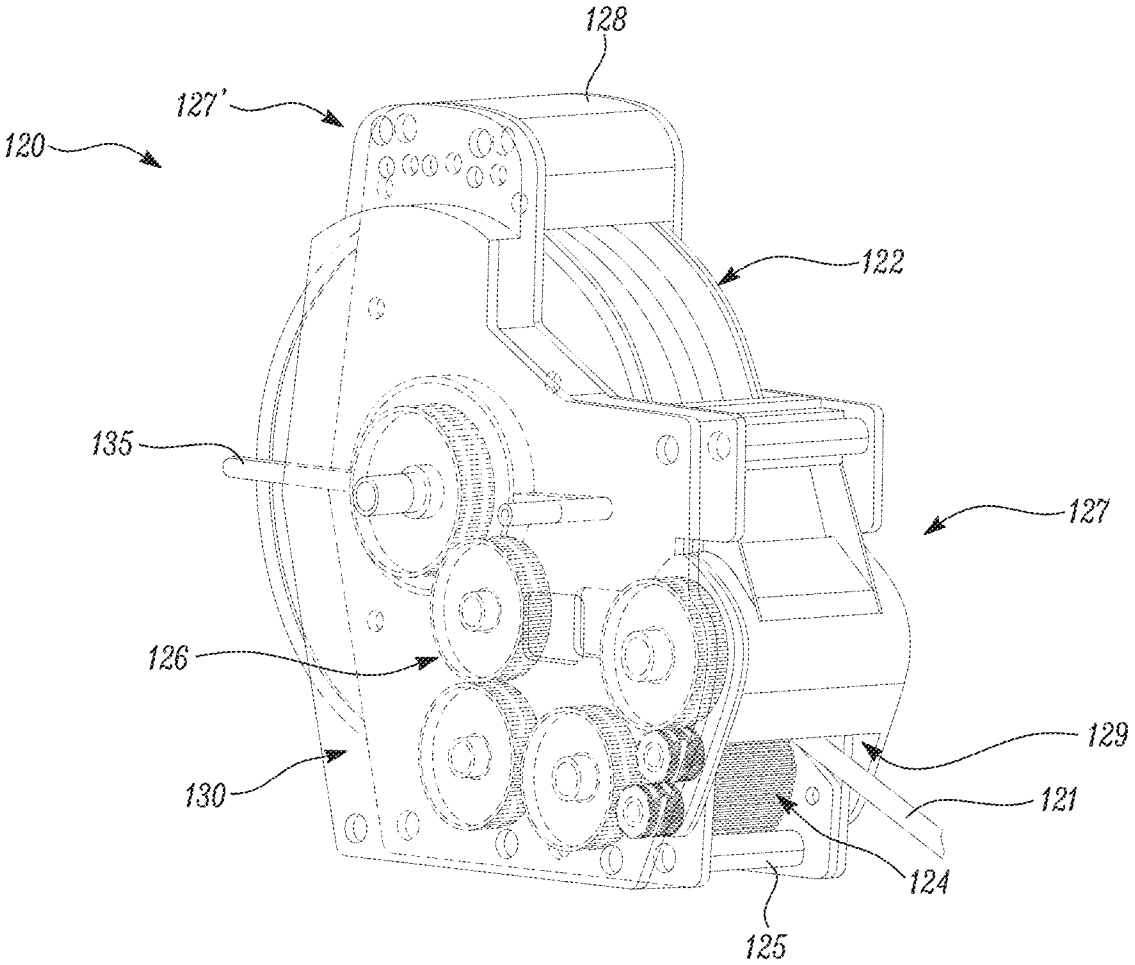
FIG. 2 shows a perspective view of a hose reel module of the mobile hose reel assembly of FIG. 1, in accordance with an aspect of the present disclosure.
Figure 3:
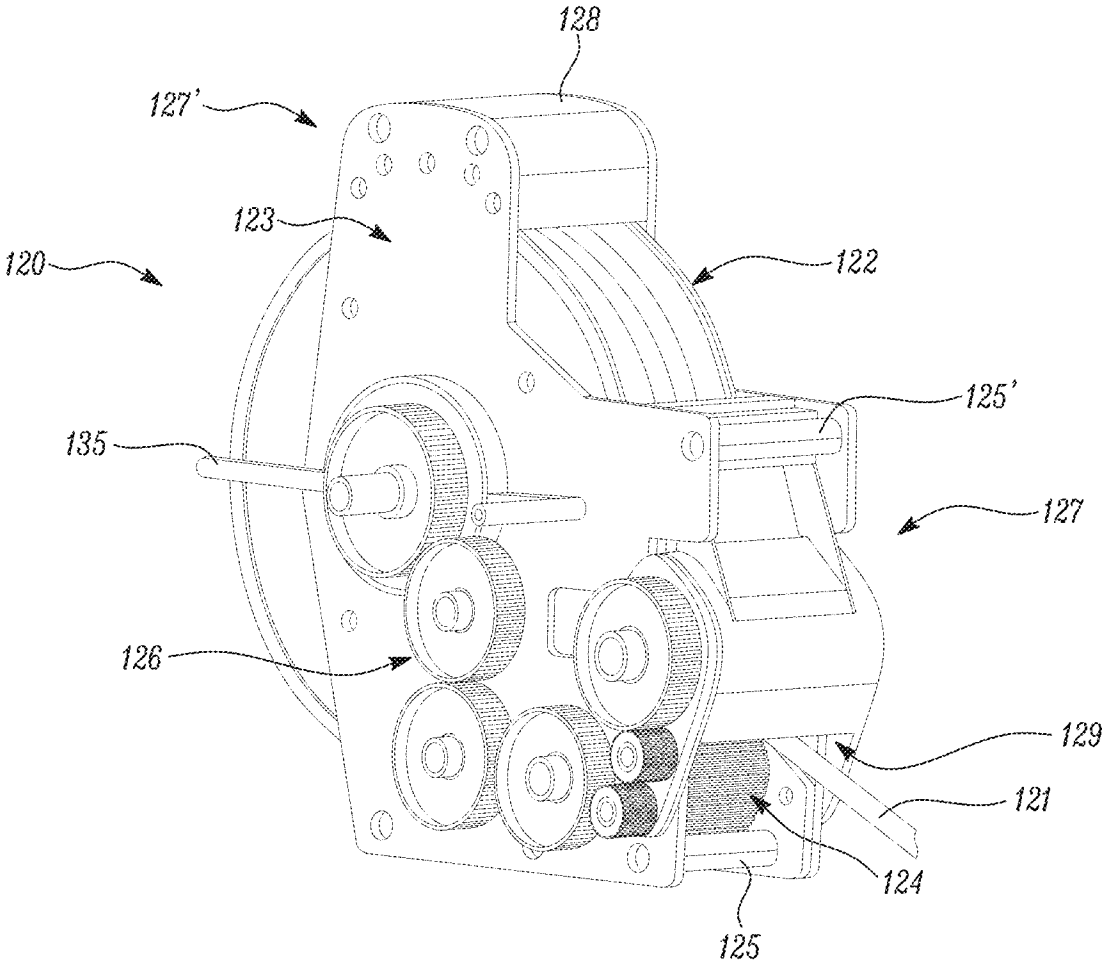
FIG. 3 shows another perspective view of the hose reel module of FIG. 2, in accordance with an aspect of the present disclosure.

Further, as illustrated in FIGS. 2 and 3, the hose reel module 120 includes an intermediate portion 128 disposed between and coupled with the pair of side walls 123. The intermediate portion 128 is coupled with the pair of side walls 123 by any means known and understood in the related art. Further, the intermediate portion 128 is coupled with the connection portion 119 of the handle portion 116 of the housing 110. The coupling between the intermediate portion 128 and the connection portion 119 is such that the hose reel module 120 is adapted to exhibit a rocking motion relative to the housing 110. The hose reel module 120 is adapted to swivel relative to the housing 110. The hose reel module 120 is adapted to oscillate relative to the housing 110. The hose reel module 120 is adapted to exhibit a pendulum like motion relative to the housing 110.

In some embodiments, the hose reel module 120 may hang within the housing 110 such that a bottom portion of the hose reel module 120 remains above the pair of brackets 111. In such embodiments, the rocking motion of the hose reel module 120 may preferably be limited proximate to the front portion 113 and back portion 113' of the housing 110. The rocking motion of the hose reel module 120 may be limited such that hose reel module 120 does not injure the operator standing close to the mobile hose reel assembly 100 or holding the mobile hose reel assembly 100 upon exhibiting the rocking motion.

In some embodiments, the hose reel module 120 may hang within the housing 110 such that a bottom portion of the hose reel module 120 is at the same level as the pair of brackets 111. In such embodiments, the rocking motion of the hose reel module 120 may be limited within the front portion 113 and back portion 113' of the housing 110 such that the hose reel module 120 does not collide with the pair of brackets 111 thereby reducing the service life of the mobile hose reel module 100.

Figure 4:
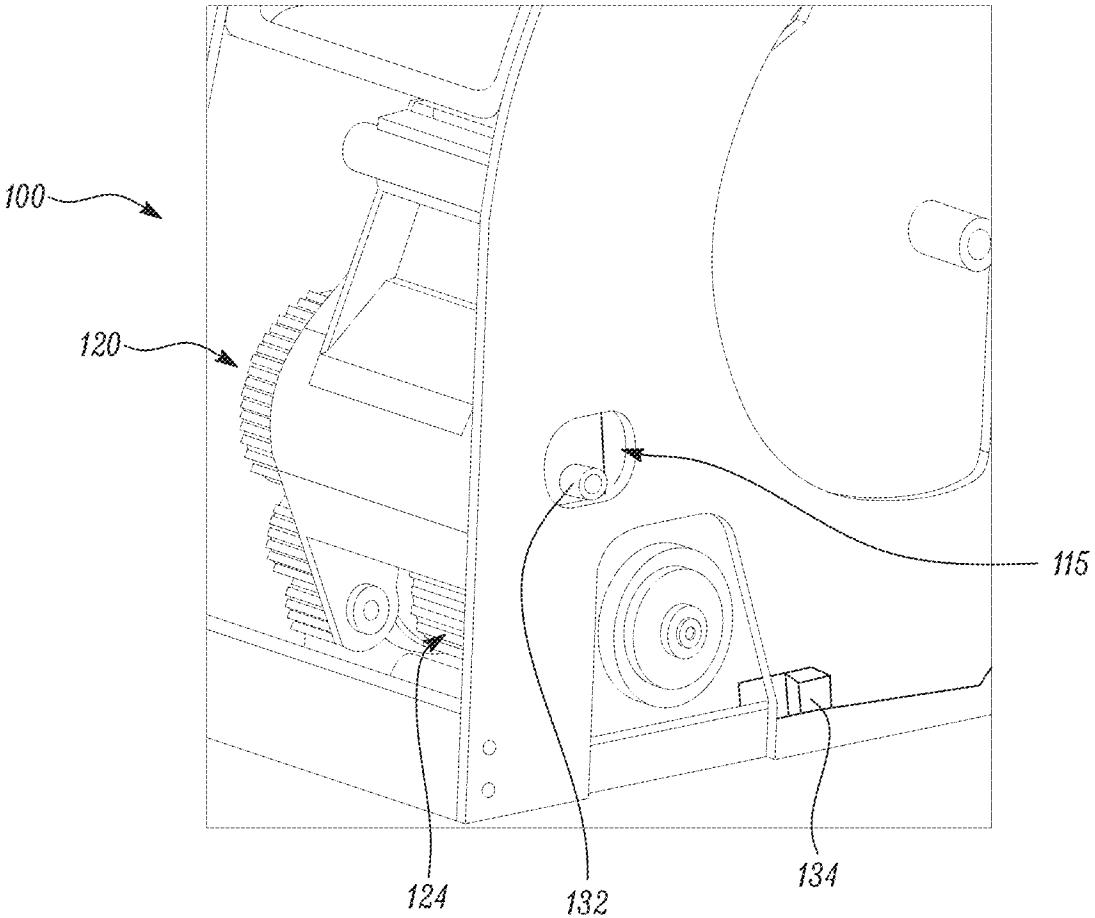
FIG. 4 shows an enlarged view of a portion of the mobile hose reel assembly of FIG. 1, in accordance with an aspect of the present disclosure.

In some embodiments, the hose reel module 120 may include a pair of protrusions 132 (as shown in FIG. 4) such that the pair of protrusions 132 protrude in one of the plurality of windows 115 provided in the first wall 112 and the corresponding window 115 on the second wall 114 of the housing 110. The window 115 then defines the extent to which the hose reel module 120 may exhibit the rocking or swiveling motion within the housing 110.

In some embodiments, the hose reel module 120 may be manufactured from same material as used with the manufacturing of housing 110. In some embodiments, the hose reel module 120 may be manufactured from different material that that used with the manufacture of the housing 110. In some embodiments, the shape of the pair of side walls 123 is similar to the shape of the first wall 112 and the second wall 114 of the housing 110. However, in some embodiments, the shape of the pair of side walls 123 is different from the shape of the first wall 112 and the second wall 114 of the housing 110.

With continued reference to FIGS. 2 and 3, the hose reel module 120 includes a hose reel 122, a drive motor 124 operatively coupled to the hose reel 122 and a transmission mechanism 126 adapted to transmit the motion of the drive motor 124 to the hose reel 122. The hose reel 122, the drive motor 124 and the transmission mechanism 126 are mechanically linked to each other for working of the mobile hose reel assembly 100. The mechanically linked parts as defined above, collectively work to wind and unwind the hose 121 stored or winded on the hose reel 122 for various non-limiting fluid distribution applications.

The hose reel 122 may be confined within the pair of side walls 123 and the intermediate portion 128 of the hose reel module 120 by any means known and understood in the related art. The hose reel 122 may have any shape and size such that it may properly confine within the hose reel module 120 and may leave ample space for the set-up of other accessories within the hose reel module 120. The hose reel 122 may preferably be cylindrical in shape. The hose reel 122 may be made from metal, fiberglass, or plastic. The hose reel 122 may be spring driven, hand-crank driven, or motor driven. However, in the preferred embodiment of the present disclosure, the hose reel 122 is motor driven, as already described above. The hose reel 122 stores the hose 121 for further usage with various industrial and domestic applications.

Further, the drive motor 124 may be a hydraulic motor or an electric motor. However, for the purpose of the present disclosure, the drive motor 124 is the electric motor. The electric motor may further be selected from a DC motor, an AC motor, a stepper motor, a brushless motor, a hysteresis motor, and the like considering the application requirements among other factors. The drive motor 124 is coupled to the pair of side walls 123 of the hose reel module 120 proximate the font portion 127 of the hose reel module 120. However, the drive motor 124 may be positioned at a different location within the hose reel module 120 as per the application requirement, space constraints, among other factors. The drive motor 124 is adapted to wind and unwind the hose 121 housed on the hose reel 122 by changing the direction of rotation of the drive motor 124. The direction of rotation of the drive motor 124 may be achieved by any means known in the related art. Further, the drive motor 124 is selectively activated and deactivated based on the rocking motion of the hose reel module 120 relative to the housing 110.

The drive motor 124 transmits the rotatory motion to the hose reel 122 via the transmission mechanism 126. In some embodiments, the transmission mechanism 126 adapted to transmit the motion of the drive motor 124 to the hose reel 122 is a gear mechanism. However, in some embodiments, the transmission mechanism 126 adapted to transmit the motion of the drive motor 124 to the hose reel 122 is a belt-drive mechanism. Either of the gear mechanism or the belt-drive mechanism may be used as per the application requirements, space constraint, maintenance, life-expectancy, among other factors. Further, in some embodiments of the present disclosure, the transmission mechanism 126 is covered or locked inside a transparent cover 130 (as shown in FIG. 2) to prevent the transmission mechanism 126 from any possible damage due to the housing 110, entry of foreign elements and the like.

In operation, the operator connects the hose 121 of the hose reel 122 with the fluid source and walks away from the fluid source to the fluid distribution area. The operator carries or moves the mobile hose reel assembly 100 away from the fluid source once the hose 121 is connected to the fluid source. This results in low traction or pulling or tensile force by the hose 121 on the hose reel 122 (or the hose reel module 120). The traction force on the hose reel 122 (or the hose reel module 120) causes the hose reel module 120 to exhibit the rocking motion relative to the housing 110. The hose reel module 120 tends to swivel towards a hose outlet 129 of the mobile hose reel assembly 100 when the tensile or the traction force acts on the hose reel 122 or the hose reel module 120.

The rocking motion of the hose reel module 120 may be detected by control electronics (not shown) provided with the mobile hose reel assembly 100 such that the control electronics activates the drive motor 124 for unwinding of the hose 121 from the hose reel 122. This is relatively a simple method to activate the drive motor 124 for unwinding process of the hose 121 when compared with the prior art methods, which involve measurement of tension value of the hose 121 by a sensor and further communication of the tension value measured by the sensor with the control electronics, which further based on stored set of algorithms decides upon when to activate or deactivate the drive motor 124. The present disclosure does not involve measurement of the tension and activates the drive motor 124 upon detection of the rocking motion of the hose reel module 120.

The drive motor 124 once activated, relieves the tension in the hose 121 and the operator easily maneuvers around one or more obstacles in the fluid distribution area without the hose 121 getting caught or stuck with the one or more obstacles such as, but not limited to, trees, planting pots, and the like, thereby improving the overall efficiency of the mobile hose reel assembly 100. Further, when there is no traction force on the hose 121, the hose reel module 120 returns back to the original position such that the drive motor 124 is automatically deactivated.

In some embodiments of the present disclosure, as illustrated in FIG. 4, the drive motor 124 is selectively activated and deactivated by a switch 134. The drive motor 124 may be manually activated or deactivated by pressing the switch 134 while carrying the mobile hose reel assembly 100. The switch 134 may be particularly advantageous in case of failure of electronics associated with detecting the rocking movement of the hose reel module 120. Further, the switch 134 is inexpensive, compact, and easily available for use with various applications.

In some embodiments of the present disclosure, the drive motor 124 is selectively activated and deactivated by detecting an angle of the hose 121 winded on the hose reel 122. The hose 121 may undergo change in angle (or orientation) relative to the hose reel module 120 upon exposure to tensile force or traction force experienced for example, when the hose 121 is coupled to the fluid source. The change in angle may be detected or measured by any means known in the art and may be used to selectively activated and deactivate the drive motor 124 for smooth functioning of the mobile hose reel assembly 100.

Figure 5:
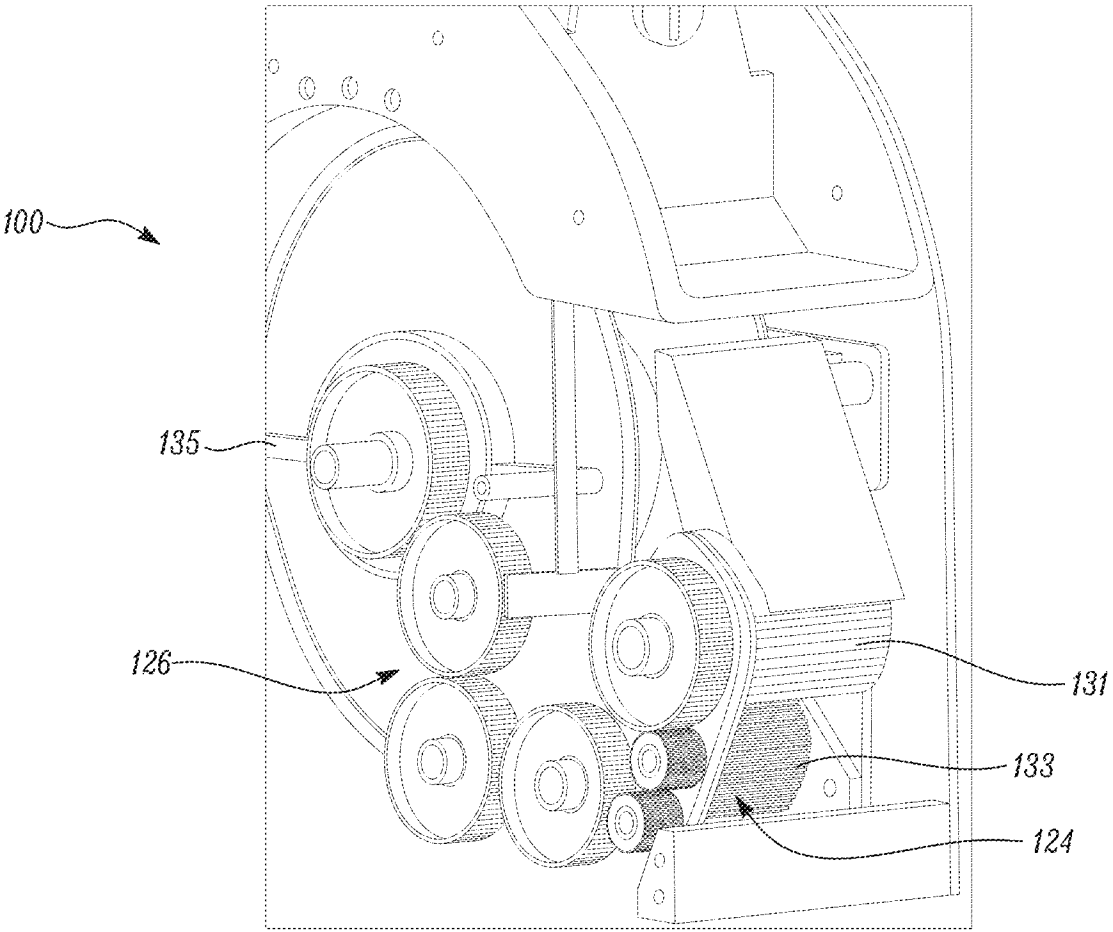
FIG. 5 shows a detailed internal view of a portion of the mobile hose reel assembly of FIG. 1, in accordance with an aspect of the present disclosure.

Further, as illustrated in FIG. 5, the mobile hose reel assembly 100 includes a pair of guide rolls 131, 133 for guiding the hose 121 (as shown in FIGS. 1, 2 and 3) during the winding and unwinding operation of the hose 121. The pair of guide rolls 131, 133 allows efficient winding and unwinding of the hose 121. The pair of guide rolls 131, 133 prevent chaotic hose winding or hose entanglement inside the hose reel 122 or the hose reel module 120. The pair of guide rolls 131, 133 are placed near the hose outlet 129 of the hose reel module 120.

The hose 121 gets clamped between the pair of guide rolls 131, 133 and during winding or unwinding, at least one of the guide rolls from the pair of guide rolls 131, 133 is driven by the drive motor 124 to pull out or pull in the hose 121 from the hose reel module 120. In the embodiment of the present disclosure, the drive motor 124 is installed in the guide roll 133. However, the drive motor 124 may be installed in the guide roll 131 depending upon the arrangement of the transmission mechanism 126, among other factors. Further, in some embodiments, the pair of guide rolls 131, 133 and the hose reel 122 may be simultaneously driven during winding and unwinding by installing equalizing or differential gear set between the pair of guide rolls 131, 133 and the hose reel 122.

In some embodiments, a speed of rotation of the hose reel 122 is adapted to be equivalent to walking speed of the operator when the amount of hose 121 on the hose reel 122 is changing during unwinding. The operator may fluidly couple the hose 121 with the fluid source and walk away from the fluid source for unwinding of the hose 121. The speed of rotation of the hose reel 122 may change with the changing radius of the hose 121 winded on the hose reel 122 and may differ from the constant speed of the hose 121 or walking speed of the operator. This may lead to cumbersome unwinding of the hose 121. The speed of rotation of the hose reel 122 may thus be controlled using a set of equalizing or differential gear set.

Further, as illustrated in FIGS. 2, 3 and 5 of the present disclosure, the mobile hose reel assembly 100 includes a slider 135 adapted to regulate the speed of rotation of the hose reel 122. The slider 135 may be used to regulate the speed of rotation of the hose reel such that the tension in the hose 121 is always relieved during the unwinding operation. In some embodiments of the present disclosure, the slider 135 disengages the transmission of power between the drive motor 124 and the hose reel 122. In some embodiments of the present disclosure, the slider 135 may function to change the direction of operation of the drive motor 124. Thus, the present disclosure provides the mobile hose reel assembly 100 that is moved or carried to different locations for fluid distribution intended for various industrial and domestic applications. The mobile hose reel assembly 100 is simple and ergonomic for usage by an operator. The mobile hose reel assembly 100 is compact and includes the hose reel module 120 that advantageously exhibits the rocking motion within the housing 110 of the mobile hose reel assembly 100. The hose reel module 120 includes the hose reel 122 and the drive motor 124 (say the electric motor) mechanically coupled with the hose reel 122. The drive motor 124 facilitates automatic unwinding or winding of the hose 121 of the hose reel assembly 100. The drive motor 124 is selectively activated and deactivated based on the rocking motion of the hose reel 122 module relative to the housing 110. The hose reel module 120 tends to swivel towards the hose outlet 129 of the mobile hose reel assembly 100 when the tensile or traction force acts on the hose reel 122 or the hose reel module 120 (possibly due to the fluid connection of the hose 121 with the fluid source). This is detected by control electronics provided with the mobile hose reel assembly 100 and the drive motor 124 is automatically activated for unwinding of the hose 121. The drive motor 124 further relieves the tension in the hose 121 such that the operator easily maneuvers around one or more obstacles in a fluid distribution area without the hose 121 getting caught or stuck with the one or more obstacles such as, but not limited to, trees, planting pots, and the like, thereby improving the overall efficiency of the mobile hose reel assembly 100.

In the drawings and specification, there have been disclosed preferred embodiments and examples of the invention and, although specific terms are employed, they are used in a generic and descriptive sense only and not for the purpose of limitation of the scope of the invention being set forth in the following claims.

a. LIST OF ELEMENTS

100 Mobile Hose Reel Assembly
110 Housing
111 Bracket
112 First Wall
113 Front Portion
113' Back Portion
114 Second Wall
115 Windows
116 Handle Portion
117 Holes
118 Handle
119 Connecting Portion
120 Hose Reel Module
121 Hose
122 Hose Reel
123 Side Walls
124 Drive Motor
125, 125' Brackets
126 Transmission Mechanism
127 Front Portion
127' Back Portion
128 Intermediate Portion
129 Hose Outlet
130 Transparent Cover
131 Guide Roll
132 Protrusions
133 Guide Roll
134 Switch
135 Slider

The invention claimed is:

1. A mobile hose reel assembly comprising:
a housing, wherein the housing includes:
a first wall;
a second wall coupled with and disposed opposite to the first wall; and
a handle portion coupled with the first wall and the second wall;
a hose reel module housed within the housing, the hose reel module including:
a hose reel;
a drive motor operatively coupled to the hose reel; and
a transmission mechanism adapted to transmit motion of the drive motor to the hose reel;
wherein the hose reel module is adapted to exhibit a rocking motion relative to the housing;
wherein the drive motor is selectively activated and deactivated by control electronics responsive to the rocking motion of the hose reel module relative to the housing being detected by the control electronics,
wherein the first wall and the second wall each comprise at least one window defining an opening through the first wall and the second wall,
wherein the hose reel module further comprises a pair of protrusions that extend into the at least one window at the first wall and the second wall, and
wherein the at least one window defines an extent to which the pair of protrusions moves relative to the first wall and the second wall during the rocking motion which therefore defines the extent to which the hose reel module exhibits the rocking motion relative to the housing.

2. The mobile hose reel assembly of claim 1, wherein the drive motor is selectively activated and deactivated by a switch.

3. The mobile hose reel assembly of claim 1, wherein the transmission mechanism adapted to transmit the motion of the drive motor to the hose reel is a gear mechanism.

4. The mobile hose reel assembly of claim 1, wherein the transmission mechanism adapted to transmit the motion of the drive motor to the hose reel is a belt-drive mechanism.

5. The mobile hose reel assembly of claim 1, wherein a speed of the hose reel is adapted to be equivalent to walking speed of an operator when an amount of hose on the hose reel is changing during unwinding.

6. The mobile hose reel assembly of claim 1, wherein the mobile hose reel assembly includes a pair of guide rolls for guiding the hose during winding and unwinding operation of the hose.

7. The mobile hose reel assembly of claim 1, wherein the mobile hose reel assembly includes a slider adapted to regulate the speed of the hose reel.

8. The mobile hose reel assembly of claim 6, wherein at least one of the guide rolls from the pair of guide rolls is driven by the drive motor.

9. The mobile hose reel assembly of claim 6, wherein the pair of guide rolls and the hose reel are simultaneously driven during winding and unwinding by installing an equalizing or differential gear set between the pair of guide rolls and the hose reel.

10. A mobile hose reel assembly comprising:
a housing, wherein the housing includes:
a first wall;
a second wall coupled with and disposed opposite to the first wall; and
a handle portion coupled with the first wall and the second wall;
a hose reel module housed within the housing, the hose reel module including:
a hose reel;
a drive motor operatively coupled to the hose reel; and
a transmission mechanism adapted to transmit motion of the drive motor to the hose reel;
wherein the hose reel module is adapted to exhibit a rocking motion relative to the housing,
wherein the drive motor is selectively activated and deactivated by control electronics responsive to the rocking motion of the hose reel module relative to the housing being detected by the control electronics, and
wherein the drive motor is selectively activated and deactivated by the control electronics responsive to the control electronics detecting an angle of a hose winded on the hose reel.

11. The mobile hose reel assembly of claim 10, wherein the drive motor is selectively activated and deactivated by a switch.

12. The mobile hose reel assembly of claim 10, wherein the transmission mechanism adapted to transmit the motion of the drive motor to the hose reel is a gear mechanism.

13. The mobile hose reel assembly of claim 10, wherein the transmission mechanism adapted to transmit the motion of the drive motor to the hose reel is a belt-drive mechanism.

14. The mobile hose reel assembly of claim 10, wherein a speed of the hose reel is adapted to be equivalent to walking speed of an operator when an amount of hose on the hose reel is changing during unwinding.

15. The mobile hose reel assembly of claim 10, wherein the mobile hose reel assembly includes a pair of guide rolls for guiding the hose during winding and unwinding operation of the hose.

16. The mobile hose reel assembly of claim 10, wherein the mobile hose reel assembly includes a slider adapted to regulate the speed of the hose reel.

17. The mobile hose reel assembly of claim 15, wherein at least one of the guide rolls from the pair of guide rolls is driven by the drive motor.

18. The mobile hose reel assembly of claim 15, wherein the pair of guide rolls and the hose reel are simultaneously driven during winding and unwinding by installing an equalizing or differential gear set between the pair of guide rolls and the hose reel.

19. The mobile hose reel assembly of claim 10, wherein the first wall and the second wall each comprise at least one window defining an opening through the first wall and the second wall, wherein the hose reel module further comprises a pair of protrusions that extend into the at least one window at the first wall and the second wall, and wherein the at least one window defines an extent to which the pair of protrusions moves relative to the first wall and the second wall during the rocking motion which therefore defines the extent to which the hose reel module exhibits the rocking motion relative to the housing.

* * * * *